US010253787B2

(12) United States Patent
Walter et al.

(10) Patent No.: US 10,253,787 B2
(45) Date of Patent: Apr. 9, 2019

(54) SELF-ALIGNING JET PUMP ASSEMBLY

(71) Applicant: Eaton Intelligent Power Limited, Dublin (IE)

(72) Inventors: Stefan Walter, Karlsruhe (DE); Vaughn Mills, Chelsea, MI (US); Daniel Lee Pifer, Chelsea, MI (US)

(73) Assignee: Eaton Intelligent Power Limited, Dublin (IE)

( * ) Notice: Subject to any disclaimer, the term of this patent is extended or adjusted under 35 U.S.C. 154(b) by 484 days.

(21) Appl. No.: 14/813,964

(22) Filed: Jul. 30, 2015

(65) Prior Publication Data

US 2015/0337865 A1 Nov. 26, 2015

Related U.S. Application Data

(63) Continuation of application No. PCT/US2013/043288, filed on May 30, 2013, which is a continuation of application No. PCT/US2013/043294, filed on May 30, 2013.

(60) Provisional application No. 61/807,461, filed on Apr. 2, 2013, provisional application No. 61/760,022, filed on Feb. 1, 2013, provisional application No. 61/760,023, filed on Feb. 1, 2013.

(51) Int. Cl.
*F04F 5/16* (2006.01)
*F04F 5/24* (2006.01)

(52) U.S. Cl.
CPC ..... *F04F 5/16* (2013.01); *F04F 5/24* (2013.01); *Y10T 137/86075* (2015.04)

(58) Field of Classification Search
CPC ..... Y10T 137/86075; Y10T 137/0324; Y10T 137/86324; Y10T 137/87587; B60K 15/035; B60K 15/03504; B60K 15/03519; B60K 2015/03509; B60K 2015/03571
See application file for complete search history.

(56) References Cited

U.S. PATENT DOCUMENTS

| | | | | |
|---|---|---|---|---|
| 3,662,780 | A | 5/1972 | Marsh | |
| 4,505,646 | A * | 3/1985 | Long | F04F 5/464 417/172 |
| D331,241 | S | 11/1992 | Price et al. | |
| 5,372,190 | A | 12/1994 | Coleman | |
| D355,199 | S | 2/1995 | Ousey | |
| 5,413,477 | A | 5/1995 | Moreland | |
| 5,458,467 | A | 10/1995 | Yuhasz | |
| D375,315 | S | 11/1996 | Paul-Johansson | |
| 6,276,387 | B1 | 8/2001 | Pachciarz et al. | |
| 6,302,137 | B1 | 10/2001 | Devall | |
| D461,827 | S | 8/2002 | Koebbe | |
| D471,563 | S | 3/2003 | Selic et al. | |

(Continued)

FOREIGN PATENT DOCUMENTS

| | | | |
|---|---|---|---|
| CN | 1552530 | A | 12/2004 |
| CN | 1776324 | A | 5/2006 |

(Continued)

OTHER PUBLICATIONS http://www.eaton.com/Eaton/ProductsServices/Vehicle/Fuel-Emissions-Control/fuel-vapor-vales/index.htm#tabs-1-3; Jun. 22, 2015.

*Primary Examiner* — Dominick L Plakkoottam
(74) *Attorney, Agent, or Firm* — Quinn IP Law

(57) ABSTRACT

A self-aligning jet pump assembly for draining a liquid trap has a jet pump nozzle and a nozzle carrier that are self-aligning.

24 Claims, 11 Drawing Sheets

(56) References Cited

U.S. PATENT DOCUMENTS

| | | | | |
|---|---|---|---|---|
| 6,698,475 | B2 | 3/2004 | Schaefer et al. | |
| D490,442 | S | 5/2004 | Kuboshima et al. | |
| 6,883,500 | B2 | 4/2005 | Powell et al. | |
| 6,895,989 | B2 | 5/2005 | Olshanetsky et al. | |
| D506,210 | S | 6/2005 | Selic et al. | |
| D520,521 | S | 5/2006 | Angeletta | |
| D540,349 | S | 4/2007 | Waki et al. | |
| 7,341,046 | B2 | 3/2008 | Leymarie et al. | |
| 7,383,856 | B2 * | 6/2008 | Martiš et al. | B60K 15/035 123/518 |
| 7,385,163 | B2 | 6/2008 | Vorenkamp et al. | |
| D584,320 | S | 1/2009 | Huang | |
| 7,475,773 | B2 | 1/2009 | Lancesseur et al. | |
| D592,681 | S | 5/2009 | Hamagishi et al. | |
| 7,546,925 | B1 | 6/2009 | Zuk, Jr. | |
| D604,331 | S | 11/2009 | Tokunaga et al. | |
| D604,332 | S | 11/2009 | Tokunaga et al. | |
| D610,166 | S | 2/2010 | Foreman | |
| 7,690,359 | B2 | 4/2010 | Price et al. | |
| D620,499 | S | 7/2010 | Sulzer et al. | |
| D623,200 | S | 9/2010 | Fulkerson et al. | |
| D641,382 | S | 7/2011 | Hawes et al. | |
| D643,442 | S | 8/2011 | Sato et al. | |
| D652,059 | S | 1/2012 | Sato et al. | |
| D682,317 | S | 5/2013 | Carruth et al. | |
| 8,485,389 | B2 | 7/2013 | Walter | |
| D700,215 | S | 2/2014 | Ueda | |
| D700,216 | S | 2/2014 | Ueda | |
| D700,623 | S | 3/2014 | Van Genechten | |
| D701,537 | S | 3/2014 | Ueda et al. | |
| 8,844,754 | B2 | 9/2014 | Pozgainer et al. | |
| 2002/0017281 | A1 | 2/2002 | Crary et al. | |
| 2003/0173365 | A1 | 9/2003 | Stickel | |
| 2003/0188786 | A1 | 10/2003 | Toki et al. | |
| 2004/0206398 | A1 | 10/2004 | Olshanetsky et al. | |
| 2005/0126633 | A1 | 6/2005 | Leonhardt | |
| 2005/0266777 | A1 * | 12/2005 | Yoon | B24C 1/003 451/40 |
| 2011/0214646 | A1 * | 9/2011 | Makino | B01D 50/00 123/518 |

FOREIGN PATENT DOCUMENTS

| | | | |
|---|---|---|---|
| DE | 20019968 | U1 | 2/2001 |
| DE | 102005011026 | A1 | 9/2006 |
| DE | 102009005826 | A1 | 7/2010 |
| EP | 1216874 | A2 | 6/2002 |
| EP | 1518739 | A2 | 3/2005 |
| EP | 1967404 | A1 | 9/2008 |
| GB | 2493958 | A | 2/2013 |
| WO | 2011045007 | A2 | 4/2011 |
| WO | 2012161978 | A1 | 11/2012 |
| WO | 2013026938 | A1 | 2/2013 |

* cited by examiner

SELF-ALIGNING JET PUMP ASSEMBLY

This application is a bypass continuation application of International Application Nos. PCT/U.S.2013/43288 and PCT/U.S.2013/043294 filed May 30, 2013, which commonly claim the benefit of U.S. Provisional Application No. 61/760,022 filed Feb. 1, 2013, U.S. Provisional Application No. 61/760,023 filed Feb. 1, 2013, and U.S. Provisional Application No. 61/807,461 filed Apr. 2, 2013, all of which are incorporated by reference in their entireties.

TECHNICAL FIELD

The present teachings generally include a jet pump assembly for draining a liquid trap.

BACKGROUND

The efficiency and functionality of a jet pump assembly is highly dependent upon the alignment of the jet pump nozzle with the diffuser at which the nozzle tip is directed. Plastic components can change their shape under different operating conditions. For example, plastic can swell in the presence of a medium such as automotive fuel, and then re-dry, shrinking to a smaller size. The relative fit of plastic components connected to one another can thus be dependent on the operating conditions.

SUMMARY

A jet pump assembly for draining a liquid trap is provided that includes a unitary nozzle carrier and a unitary venturi nozzle. The unitary nozzle carrier has a wall with an entrance port. The nozzle carrier has a longitudinal passage extending through the nozzle carrier and in fluid communication with the entrance port. The unitary venturi nozzle has an inlet and a nozzle tip forming an outlet. The nozzle carrier and the venturi nozzle are configured so that the venturi nozzle fits to the nozzle carrier in the longitudinal passage with the nozzle tip extending past the entrance port. The nozzle tip is in fluid communication with the entrance port. The alignment of a longitudinal axis of the venturi nozzle with a longitudinal axis of the nozzle carrier is thus dependent only on the fit of the carrier portion and the venturi nozzle when the venturi nozzle is fit to the carrier portion.

The above features and advantages and other features and advantages of the present teachings are readily apparent from the following detailed description of the best modes for carrying out the present teachings when taken in connection with the accompanying drawings.

DETAILED DESCRIPTION

Figure 1:
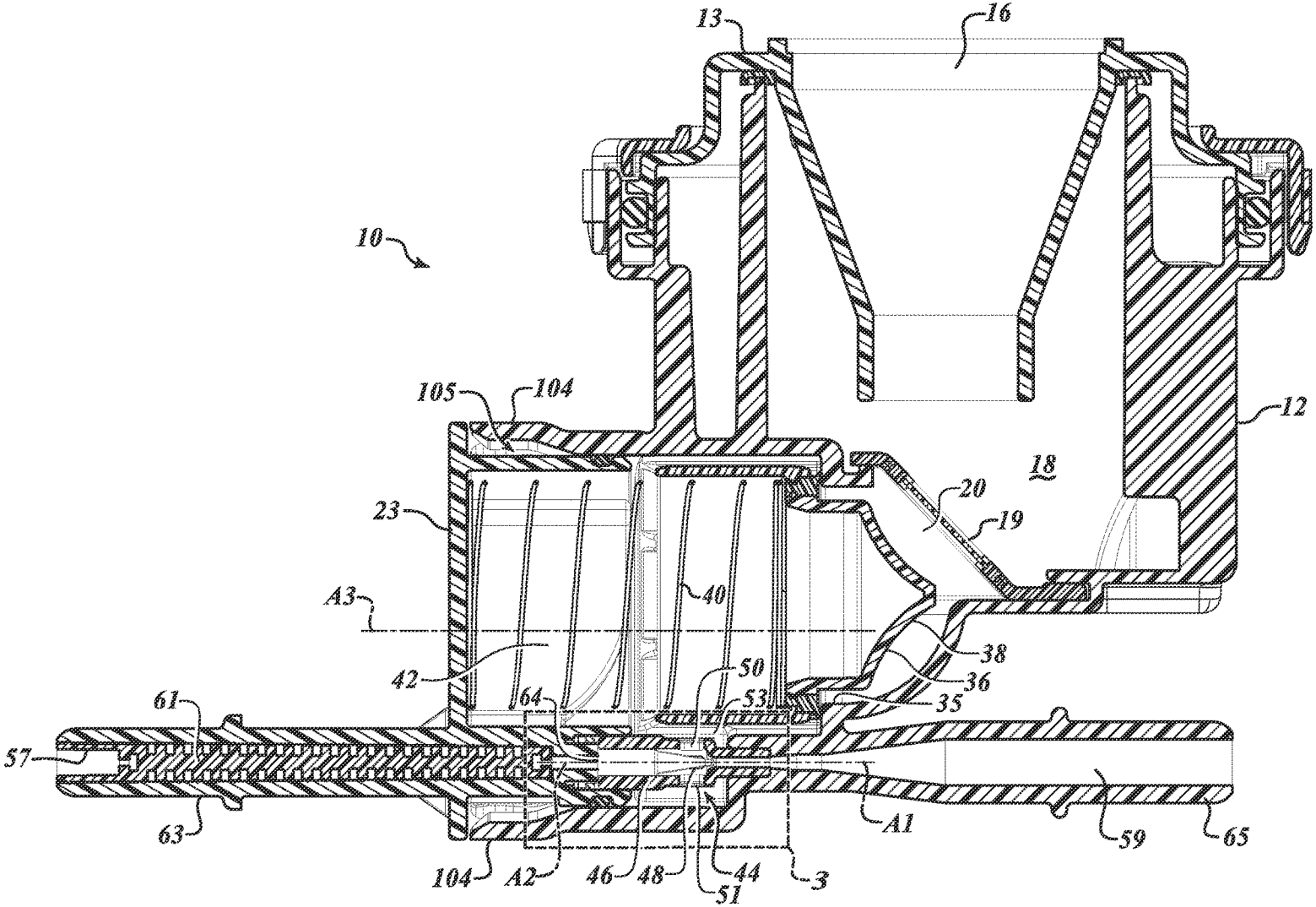
FIG. 1 is a schematic illustration in cross-sectional view of a liquid trap assembly with a liquid trap and an integrated jet pump assembly, taken at the lines 1-1 in FIG. 2.
Figure 2:
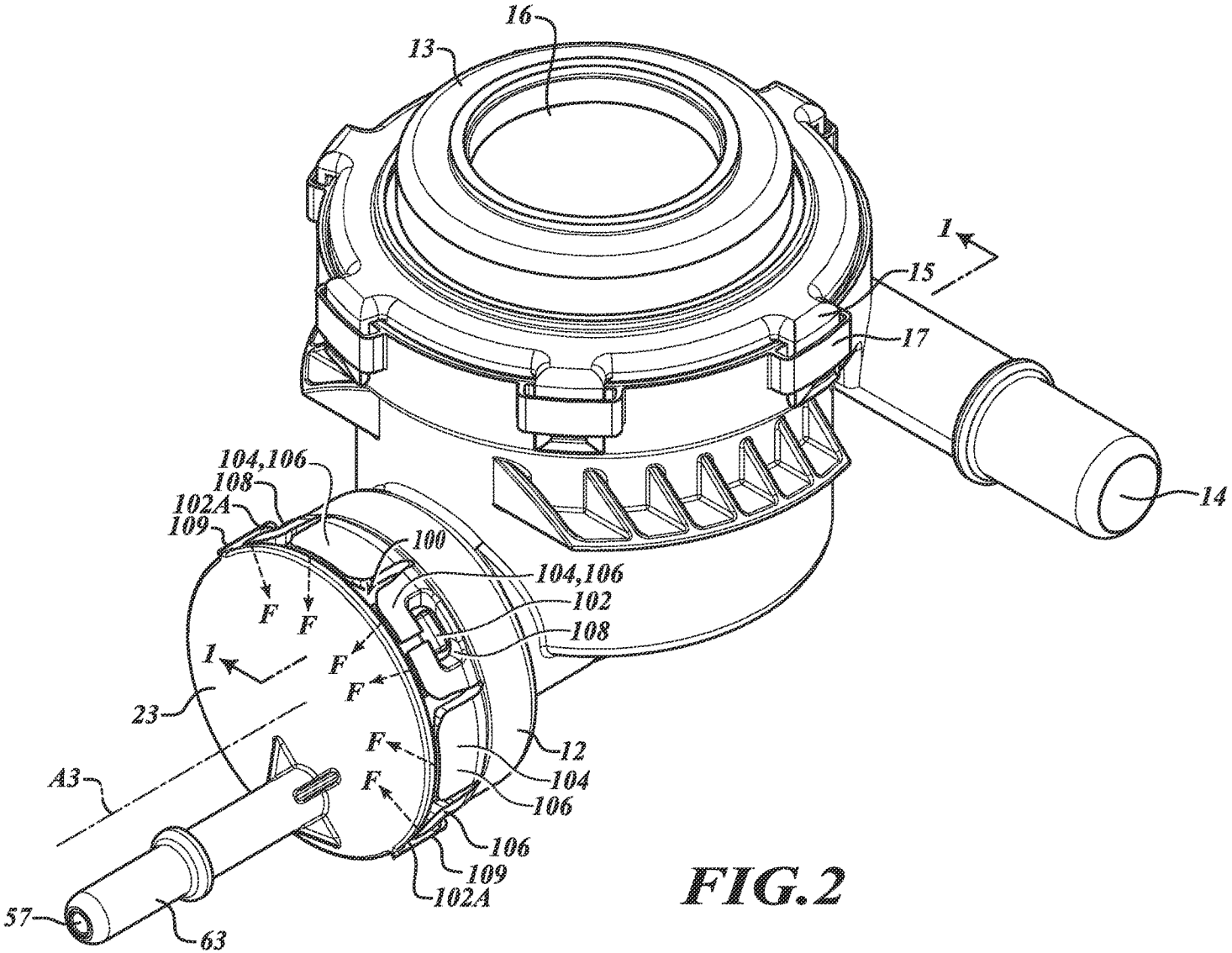
FIG. 2 is a schematic perspective illustration of the liquid trap assembly assembly of FIG. 1.

Referring to the drawings, wherein like reference numbers refer to like components throughout the several views, FIG. 1 shows a liquid trap assembly 10 that efficiently drains liquid collected from vapor. The liquid trap assembly 10 can also be referred to as an active liquid drain. The liquid trap assembly 10 has a housing 12. The housing 12 has a first port, referred to as a vapor flow inlet 14 (shown in FIG. 2) and a second port, referred to as a vapor flow outlet 16 in fluid communication with an interior cavity 18 formed at least in part by the housing 12. As shown in FIG. 2, the outlet 16 is formed by an upper cap 13 secured to the housing 12 with tabs 15 fit through tab retainers 17. Vapor flows from the vapor flow inlet 14, through the cavity 18, to the vapor flow outlet 16. Liquid entrained in the vapor flow is collected in a liquid trap 20 formed by the housing 12 at the bottom of the housing 12. A filter 19 extends across the lowest portion of the trap 20. The outlet 16 can be replaced by an outlet valve, or the housing 12 can have no outlet.

An end cap 23 is connected to the housing 12 in a manner described herein. The housing 12 can be a one-piece, molded plastic component. The end cap 23 can also be a one-piece, molded plastic component. Either or both of the housing 12 and an end cap 23 described can have features that promote separation of liquid and vapor, such as baffles and ribs. As used herein, the end cap 23 is referred to as a first component of the liquid trap assembly 10, and the housing 12 is referred to as a second component of the liquid trap assembly 10.

The liquid trap assembly 10 can be used in many applications. In one application described herein, the liquid trap assembly 10 is used in a fuel vapor recovery system 21 on a vehicle, shown schematically in FIG. 9. The vehicle can be a diesel, gasoline, or hybrid application. Vapor is vented from a fuel tank 22 that contains liquid fuel 93. The vapor is vented through a vapor vent valve 26 that may provide pressure relief, rollover shutoff, and other functions. Vapor flows from the vapor vent valve 26 to the liquid trap assembly 10 through the inlet 14 and exits through the outlet 16 to a vapor recovery device, such as a canister (C) 28 filled with carbon granules. The canister 28 is periodically purged to an engine (E) 30. The liquid trap assembly 10 is shown mounted within the fuel tank 22. Alternatively, the liquid trap assembly 10 can be external to the fuel tank 22.

Referring to FIG. 1, the housing 12 forms a first opening 35 in a sidewall adjacent to the liquid trap 20. The opening 35 is selectively closed by a check valve 36. Any type of valve can be used to close the opening 35, or there can be no valve at the opening 35. The check valve 36 includes a valve body 38 and a spring 40 that biases the valve body 38 into the first opening 35 to close the opening 35 and separate the cavity 18 and liquid trap 20 from a valve cavity 42 in which the spring 40 and valve body 38 are movable, as described herein. When the check valve 36 closes the opening 35, it also prevents liquid from entering or exiting the liquid trap 20 through the opening 35. The valve body 38 is generally annular and has a generally cone-shaped end that extends into the cavity 18. The spring 40 has a diameter that fits inside the generally annular valve body 38. A valve body with a different shape can also be used. For example, a ball valve may be used to close the opening 35.

Figure 3:
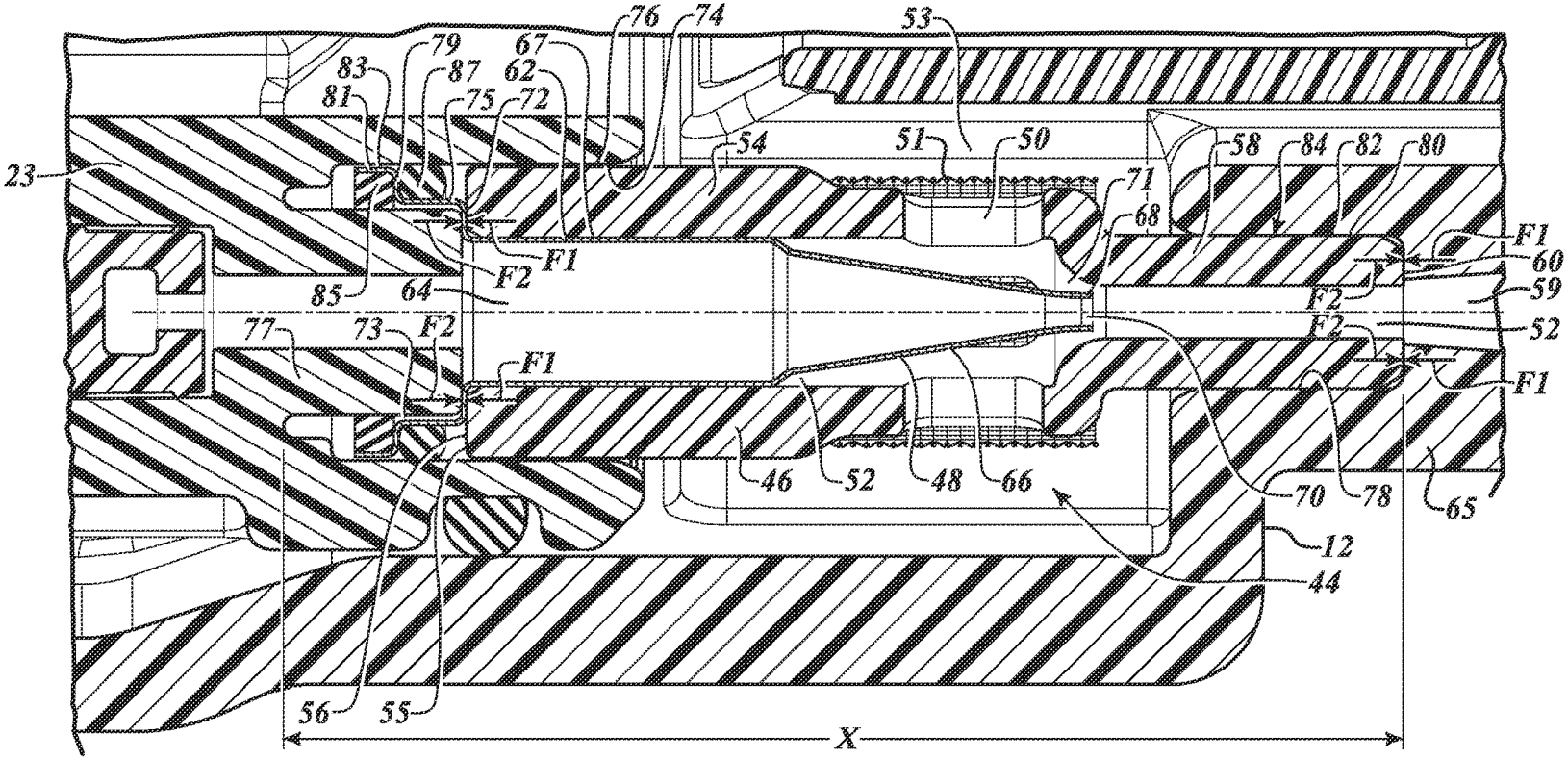
FIG. 3 is a schematic illustration in fragmentary cross-sectional view of the jet pump assembly supported in the liquid trap assembly of FIG. 1.
Figure 7:
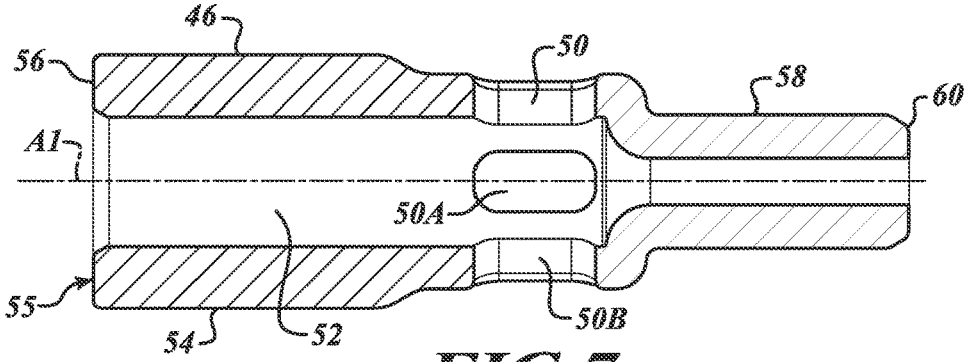
FIG. 7 is a schematic cross-sectional illustration taken at lines 7 in FIG. 4 of a nozzle carrier of the jet pump assembly of FIG. 4 with the venturi nozzle removed.

The liquid trap assembly 10 includes a jet pump assembly 44. The jet pump assembly 44 includes a nozzle carrier 46 and a venturi nozzle 48. The nozzle carrier 46 has an entrance port 50 that extends through a generally annular outer wall 55 of the nozzle carrier 46 in operative fluid communication with the liquid trap 20, as best shown in FIG. 1. That is, a lower extent 53 of the cavity 42 is in communication with the entrance port 50. When the valve 36 opens, the spring 40 depresses, and the valve body 38 will move past the lower extent 53 (to the left in FIG. 1) so that the liquid trap 20 empties to the lower extent 53 and through the entrance port 50 into a longitudinal passage 52 (shown in FIG. 3) of the nozzle carrier 46. The longitudinal passage 52 extends completely through the nozzle carrier 46 as best shown in FIGS. 3 and 7, and is larger in the carrier portion 54 than in the diffuser portion 58. The longitudinal passage 52 is in fluid communication with the entrance port 50. The valve 36 is configured to prevent draining of the liquid trap 20 by the jet pump assembly 44 when a pressure differential created by liquid flow through the venturi nozzle 48 is below a predetermined level, and to allow fluid communication between the jet pump assembly 44 and the liquid trap 20 when the pressure differential is above the predetermined level. It should be appreciated, however, that the valve 36 is optional, and the jet pump assembly 44 could drain the liquid trap 20 sufficiently if no valve 36 was present.

Figure 9:
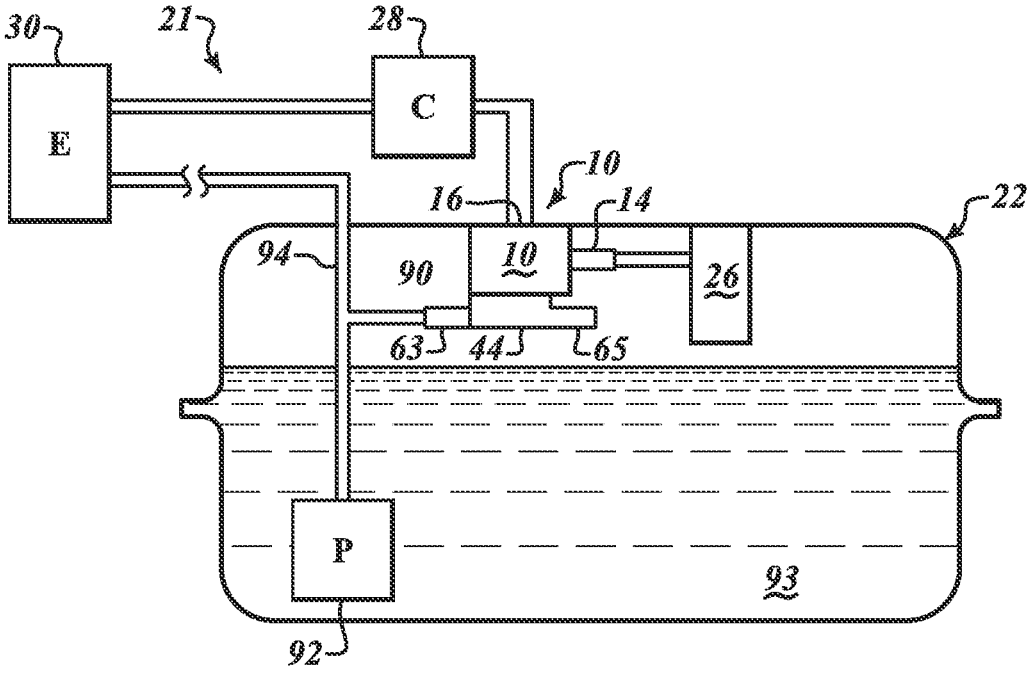
FIG. 9 is a schematic illustration of the liquid trap assembly of FIG. 1 mounted in a fuel tank and part of a vehicle fuel system.
Figure 10:
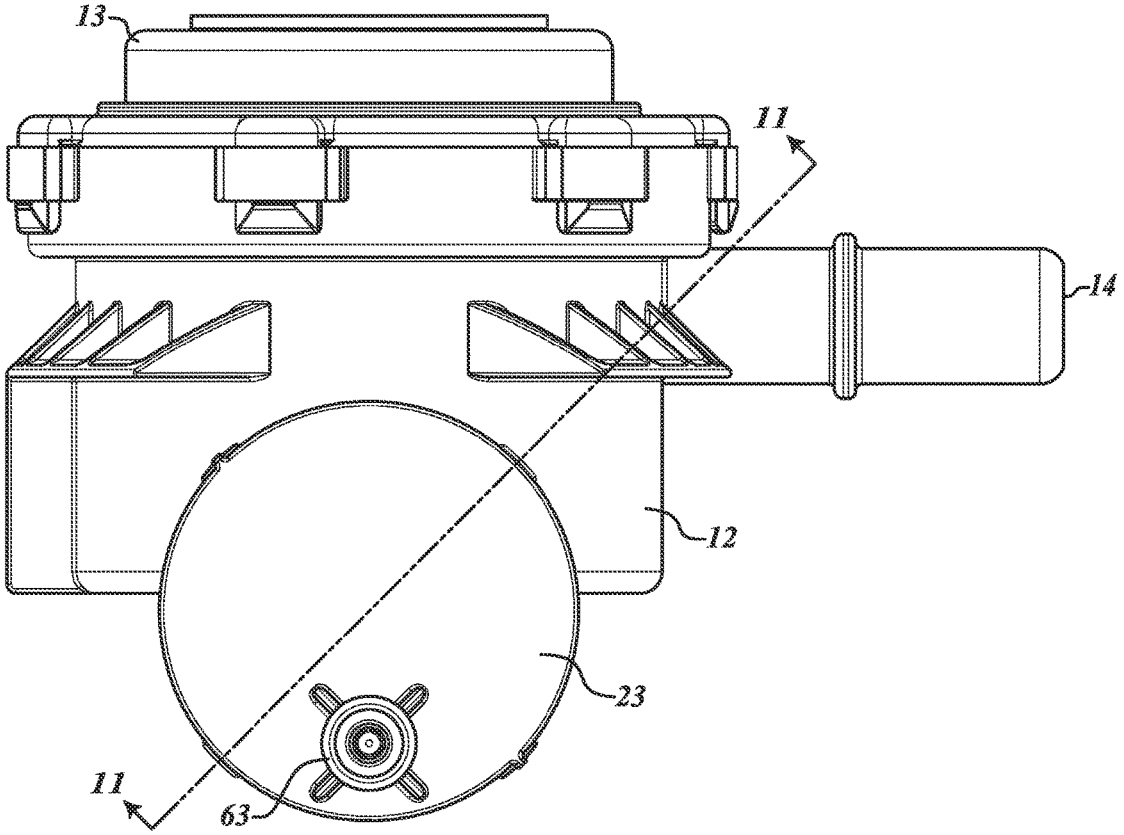
FIG. 10 is a schematic illustration in end view of the liquid trap assembly of FIG. 1.

Flow through the venturi nozzle 48 induces draining of the liquid trap 20. As shown in FIG. 9, the jet pump assembly 44 is connected by tubing 90, 94 to a fuel pump 92 submerged in the liquid fuel 93. The fuel pump 92 is also connected to the engine 30 via fuel discharge tubing 94. Fuel is discharged from the fuel pump 92 at relatively high pressure through the fuel discharge tubing 94. The tubing 90 branches from the fuel discharge tubing 94, providing relatively high pressure liquid fuel flow to an inlet portion 63 of the housing 12 that is in fluid communication with an inlet 64 of the nozzle 48 indicated in FIG. 3.

Referring again to FIG. 1, fluid flowing out of the nozzle 48 creates a vacuum or at least a relatively low pressure area in the longitudinal passage 52 adjacent the entrance port 50. Pressure is also reduced in the cavity 42 due to the vacuum or low pressure in the longitudinal passage 52, creating a pressure differential across the valve body 36, as pressure in the cavity 42 is lower than pressure in the cavity 18. When the pressure differential reaches a predetermined level such that a force created by the pressure differential on the area of the valve body 38 exposed to the cavity 18 is greater than the force keeping the check valve 36 shut (in this case the force of the spring 40), the valve body 38 will move toward the end cap 23, compressing the spring 40 and establishing fluid communication between the liquid trap 20 and the entrance port 50. The jet pump assembly 44 is a fuel discharge assembly that has the propelling mechanism, due to the pressure differential and jet action through the nozzle 48, to discharge liquid fuel in the trap 20 to the fuel tank 22.

The jet pump assembly 44 utilizes high pressure fluid from the fuel pump 92 which flows through the nozzle 48 with a high velocity. The flow through the nozzle 48 is referred to as the primary flow or primary stream. The high velocity fluid leaving the nozzle 48 creates a low pressure or a vacuum in the area adjacent the nozzle 48, such as at the entrance port 50. The pressure differential between the high pressure fluid exiting the nozzle 48 and the lower extent 53 of the cavity 42 adjacent the nozzle 48 induces flow, such as through the entrance port 50, referred to as an induced stream or secondary flow.

Referring to FIG. 1, the jet pump assembly 44 has an optional pressure reducer 61 located in the passage 57 formed by the inlet portion 63 of the housing 12, upstream of the inlet 64 and the nozzle 48. The pressure reducer 61 can instead be located further upstream of the jet pump assembly 44 such as in a vent line leading to the jet pump assembly 44. The pressure reducer 61 reduces pressure and volume flow rate of fluid flow through the inlet portion 63 to the nozzle 48, while increasing velocity of flow through the nozzle 48.

A diffuser portion 58 of the nozzle carrier 46 is shown in FIG. 3 supported by the housing 12. The longitudinal passage 52 in the diffuser portion 58 is in fluid communication with a diffuser passage 59 formed by an outlet 65 of the housing 12 (best shown in FIG. 1) to increase pressure and reduce velocity of the fluid. Many factors affect the performance and efficiency of the jet pump assembly 44, including fluid molecular weight, feed temperature, position of the nozzle 48, throat dimension, motive velocity, Reynolds number, pressure ratio, specific heat ratio, and the angle between the motive and induced stream.

Figure 4:
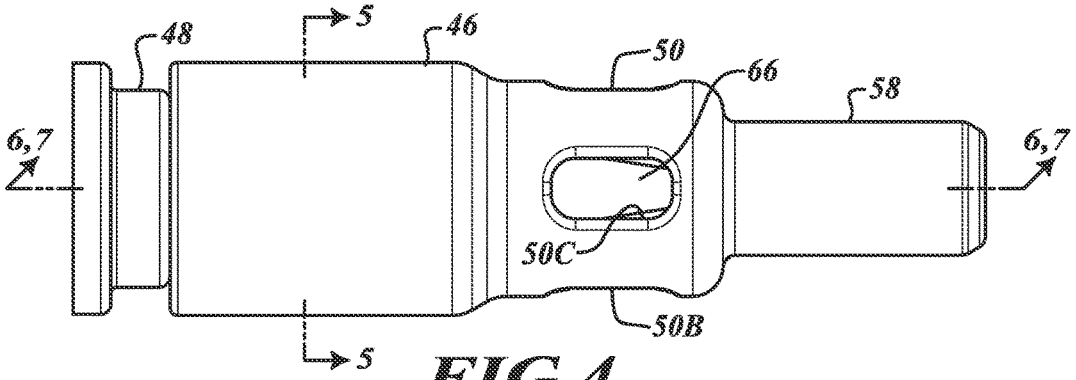
FIG. 4 is a schematic side view illustration of the jet pump assembly of FIG. 1.

The nozzle carrier 46 also has a carrier portion 54 extending from a first end 56 of the nozzle carrier 46 to the entrance port 50. The diffuser portion 58 of the nozzle carrier 46 extends from the entrance port 50 to a second end 60 of the nozzle carrier 46 opposite the first end 56. FIGS. 4 and 7 show that there are several additional ports 50A, 50B, 50C that extend through the nozzle carrier 46, and are spaced angularly about the nozzle carrier 46 in the vicinity of the entrance port 50. A fourth entrance port 50 is opposite port 50C and between ports 50 and 50B. A filter 51 shown in FIG. 3 surrounds the nozzle carrier 46 at the port 50 to screen liquid entering the port 50 from the trap 20. The nozzle carrier 46 has a longitudinal center axis A1.

Figure 5:
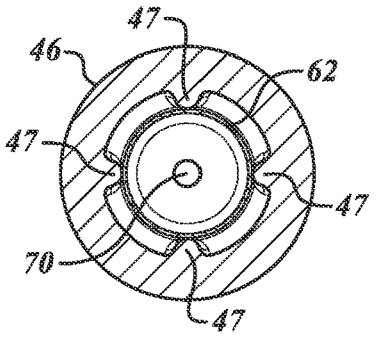
FIG. 5 is a schematic illustration in cross-sectional view of the jet pump assembly in FIG. 4 taken at lines 5-5 in FIG. 4.
Figure 6:
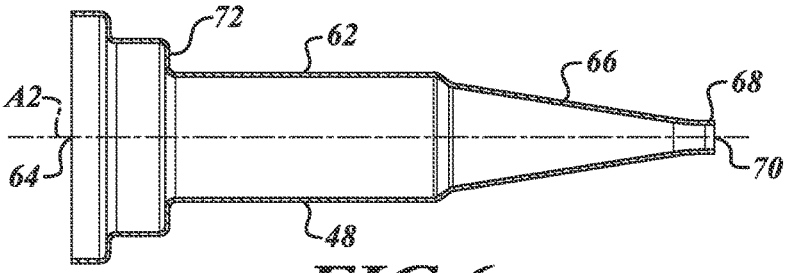
FIG. 6 is a schematic cross-sectional illustration taken at lines 6 in FIG. 4 of a venturi nozzle of the jet pump assembly of FIG. 4 with the nozzle carrier removed.

The venturi nozzle 48 has a body portion 62 with an inlet 64, and a nozzle portion 66 with a nozzle tip 68 forming an outlet 70. The nozzle 48 also has a longitudinal center axis A2. The nozzle carrier 46 and the venturi nozzle 48 are configured so that the body portion 62 fits to the carrier portion 54 in the longitudinal passage 52, with the nozzle portion 66 extending past the entrance port 50 so that the nozzle tip 68 is directed into the diffuser portion 58. The fit of the body portion 62 to the carrier portion 54 is a press-fit. As shown in FIG. 5, the nozzle carrier 46 has spaced, radially-inwardly extending ridges 47 extending into the longitudinal passage 52 so that the body portion 62 of the venturi nozzle 48 is fit to the carrier portion 54 of the nozzle carrier 46 at the ridges 47.

The nozzle 48 is inserted into the longitudinal passage 52 from the first end 56 until a first stepped shoulder 72 of the body portion 62 abuts an outer wall 55 of the nozzle carrier 46 at the first end 56. In this position, a predetermined clearance 71 exists between the tip 68 and the inner wall of the diffuser portion 58 defining the passage 52.

Alignment of the longitudinal axis A2 of the venturi nozzle 48 with the longitudinal axis Al of the nozzle carrier 46 is dependent only on the nozzle carrier 46 and the venturi nozzle 48 when the venturi nozzle 48 is fit to the nozzle carrier 46 in this manner. More specifically, all other surrounding components that support the jet pump assembly 44 are configured to have larger radial clearances between the jet pump assembly 44 and the components than a clearance 67 of the tight press-fit of the body portion 62 of the nozzle 48 to the carrier portion 54 of the nozzle carrier 46. The axes A1, A2 remain substantially aligned under all operating conditions due to the controlled clearance 67. For example, in FIG. 3, the carrier portion 54 is supported by the end cap 23 in a first cylindrical cavity 74 of the end cap 23. A first clearance 76 between the end cap 23 and the carrier portion 54 is much larger than the press-fit clearance 67 of the nozzle body portion 62 to the carrier portion 54. A clearance 73 between a first stepped portion 75 of the nozzle 48 and a cylindrical extension 77 of the end cap 23 is also larger than the clearance 67 of the nozzle 48 to the nozzle carrier 46. Finally, a second shoulder 79 of the nozzle 48 flares outward to form a second shoulder portion 81. A clearance 83 between the second shoulder portion 81 and the end cap 23 in the cavity 74 is larger than the press-fit clearance 67 of the nozzle 48 to the nozzle carrier 46. A resilient ring 85 stabilizes the second shoulder portion 81 on the extension 77. A resilient 0-ring seal 87 stabilizes the first shoulder portion 75 on the extension 77.

The diffuser portion 58 of the nozzle carrier 46 is press-fit to the housing 12 in a cylindrical cavity 78 of the housing 12 along only a small press-fit portion 80 of an exterior surface 84 of the diffuser portion 58. In other words, the radial clearance 82 between the diffuser portion 58 and the housing 12 at the cavity 78 is greater in all other areas than at the press-fit portion 80. The nozzle 48 can be a machined, deep drawn metal in order to ensure the precise press-fit clearance 67 of the nozzle 48 to the nozzle carrier 46. The nozzle carrier 46 can be a plastic injection-molded component such as a glass-filled polyoxymethylene plastic (POM) or similar grade with a predetermined low fuel-swell performance in the presence of automotive fuel.

Figure 8:
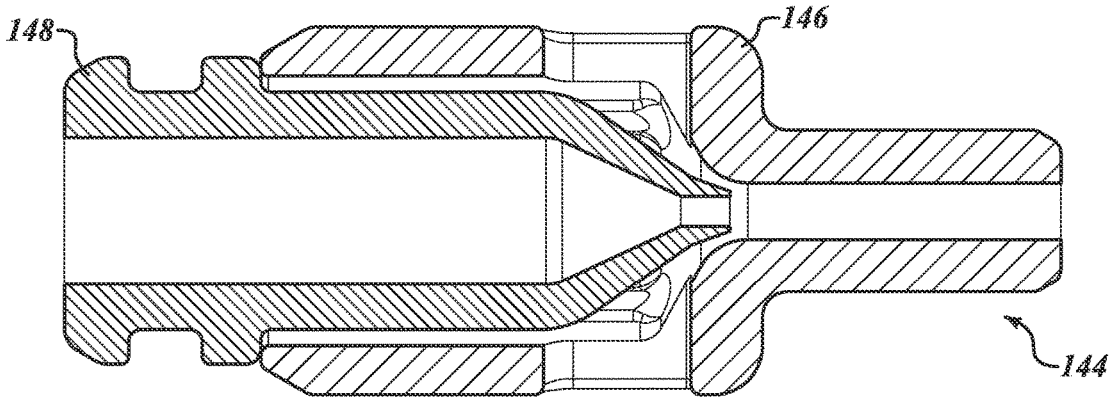
FIG. 8 is a schematic illustration in cross-sectional view of an alternative jet pump assembly for use in the liquid trap assembly of FIG. 1.

In an alternative embodiment of a jet pump assembly 144 shown in FIG. 8, the nozzle carrier 146 can be machined, deep drawn metal, and the nozzle 148 can be a plastic injection molded component such as a glass-filled POM or similar grade plastic with a predetermined low fuel-swell performance in the presence of automotive fuel. In still other embodiments, both the nozzle and the nozzle carrier can be a deep drawn metal, or both can be injection-molded plastic components.

The components of the jet pump assembly 44, the end cap 23, and the housing 12 are configured so that the clearances 67, 71, 73, 76, 82, 83 and other clearances are not less than predetermined minimum clearances under a predetermined range of operating conditions that includes a maximum fuel swell condition and a re-dry of the components from the fuel swell condition. Under this configuration, variations in the sizes of the radial clearances 67, 71, 73, 76, 82, 83 will not affect the relative fit of the nozzle 48 to the nozzle carrier 46. The assembled nozzle 48 and nozzle carrier 46 will be able to move radially as a unit relative to the end cap 23 and the housing 12, and to rotate as a unit relative to the end cap 23 and the housing 12 about the aligned longitudinal center axes Al, A2 without affecting the alignment of the longitudinal axis A1 of the nozzle carrier 46 with the longitudinal axis A2 of the nozzle 48. If the entire jet pump assembly 44 rotates as a unit, the additional ports 50A, 50B, etc. will allow liquid to drain into the longitudinal passage 52 as one will be in communication with the lower extent 53 regardless of the position of the port 50 relative to the lower extent 53.

Figure 18:
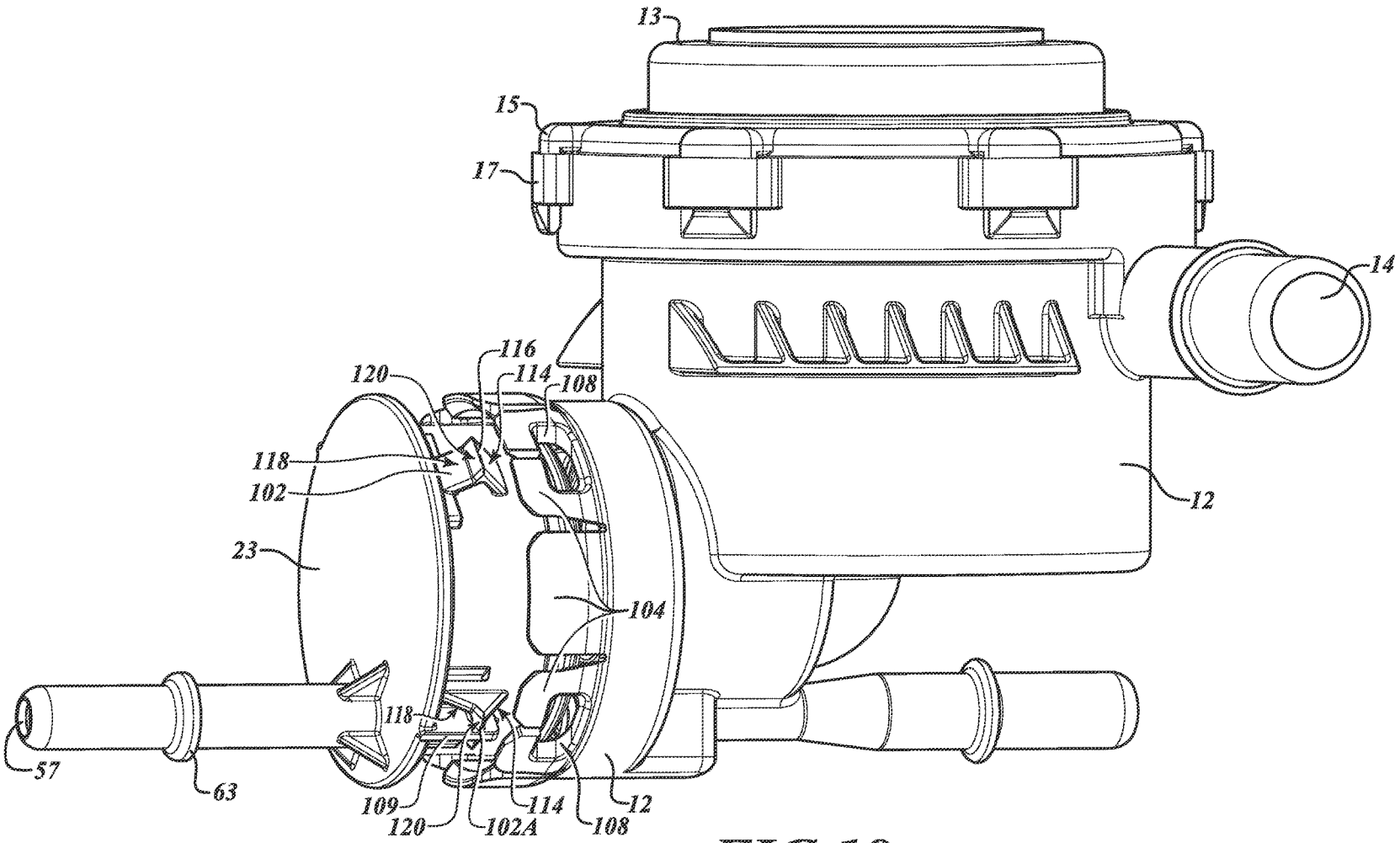
FIG. 18 is a schematic illustration in exploded perspective view of the liquid trap assembly of FIG. 2.

In order for the the nozzle 48 to remain sufficiently axially aligned with the nozzle carrier 46 throughout the range of operating conditions, a constant axial compressive force should be maintained in the jet pump assembly 44. Accordingly, the liquid trap assembly 10 provides a constant tension snap-fit between a first component (i.e., the end cap 23) and a second component (i.e., the housing 12) to create a constant axial compressive force on additional components, such as a the nozzle 48 and the nozzle carrier 46, supported by and between the first and second components to prevent relative axial movement of the nozzle 48 and the nozzle carrier 46. As best shown in FIGS. 2 and 18, the end cap 23 has a first outer surface 100 and a plurality of spaced extensions 102 and 102A extending outward from the first outer surface 100. The first outer surface 100 is generally cylindrical.

The housing 12 has a flexible rim 104 surrounding and partially defining a cavity 105, indicated in FIG. 1. The cavity 105 is configured to contain a portion of the end cap 23 when the end cap 23 is partially inserted into the cavity 105, and to contain the cavity 42 with spring 40 and check valve 36. The flexible rim 104 is generally cylindrical and is configured to surround the first outer surface 100 when the end cap 23 is fit partially within the cavity 105. The flexible rim 104 is shown with discrete flap portions 106 in FIG. 2, but could instead be continuous and unsectioned.

The flexible rim 104 has spaced recesses 108 that have a spacing substantially equal to the spacing of the extensions 102, 102A. The rim 104 flexes to surround the end cap 23 and trap the extensions 102 in the recesses 108. Although flexible, the rim 104 remains biased toward an unflexed state when in the flexed state shown in FIG. 2. The unflexed state is the position of the rim 104 when the end cap 23 is removed from the cavity 105. In the unflexed state, the effective diameter of the rim 104 will be less than in the flexed state. In other words, the flexible rim 104 is configured with a material, such as a plastic, that has sufficient stiffness to return to a pre-stressed or unflexed state when an object or force causing the flexed state is removed. When flexed, the flexible rim 104 provides a constant radially-inward force F (i.e., a force toward the center axis A3 of the flexible rim 104) as shown in FIG. 2. As shown in FIG. 18, some of the extensions 102A have a center portion 109 that interrupts the angled surfaces and acts as an anti-rotation feature to prevent axial movement of the end cap 23 relative to the housing 12. The end cap 23 and the housing 12 can be the same material or a different material, such as the same or different types of plastic that can swell and shrink in the presence of fuel or other medium over the range of operating conditions.

The extensions 102, 102A and the flexible rim 104 are configured so that the extensions 102, 102A will be retained in the recesses 108 and will prevent the rim 104 from returning to the unflexed state over a predetermined range of operating conditions experienced by the assembly 10 during use. As explained herein, the constant radially-inward force F of the rim 104, illustrated at each flap portion 106 of FIG. 2, creates a force F1 at the interface of each extension 102 with the rim 104 that pulls the housing 12 toward the end cap 23, and a reaction force F2 at the interface of each extension 102, 102A with the rim 104 that pushes the end cap 23 toward the housing 12. The forces F1, F2 are maintained over the predetermined range of operating conditions due to the bias of the rim 104 toward the unflexed state. The force F1 and reaction force F2 are in opposite directions, and are parallel with a center axis A3 of the end cap 23 and flexible rim 104 shown in FIG. 1. The center axis A3 is in turn parallel with the aligned axes A1, A2 of the nozzle 48 and nozzle carrier 46.

Figure 11:
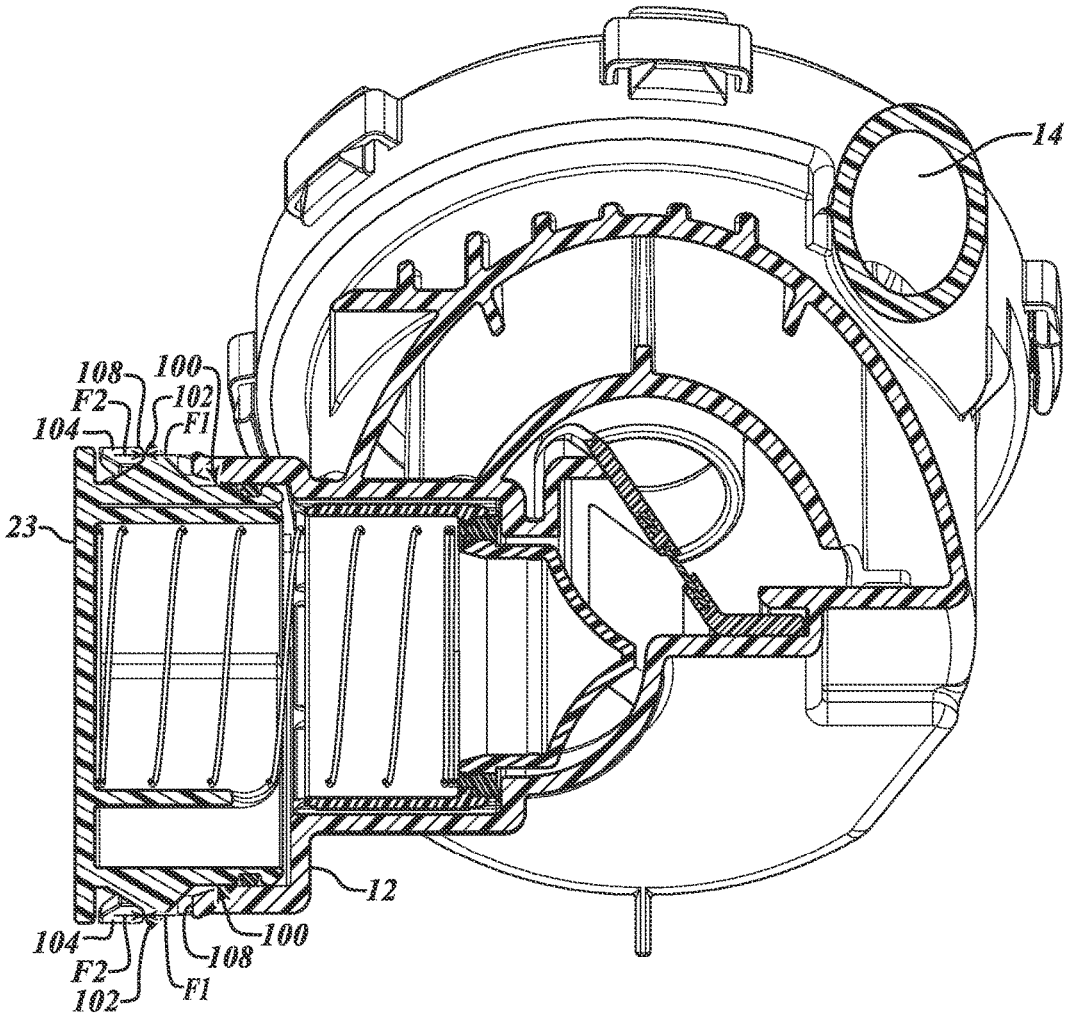
FIG. 11 is a schematic illustration in cross-sectional view of the liquid trap assembly taken at lines 11-11 in FIG. 10 and showing a housing connected to an end cap.
Figure 12:
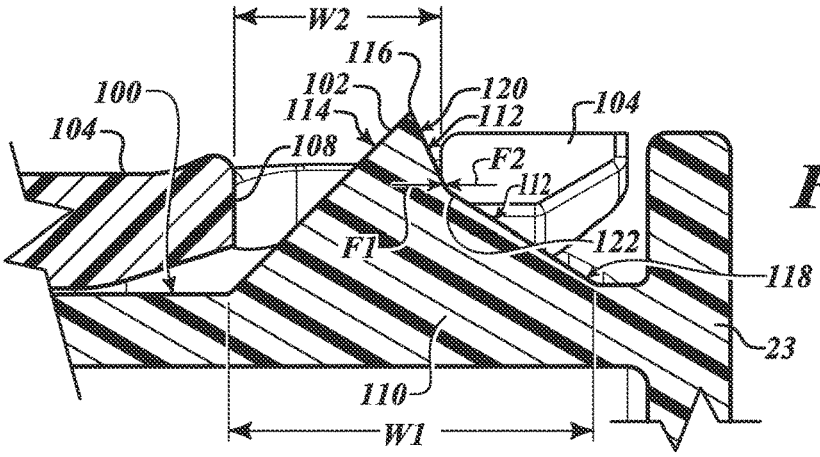
FIG. 12 is a close-up fragmentary cross-sectional view of an extension of the housing trapped in a recess of the end cap under a first operating condition.
Figure 13:
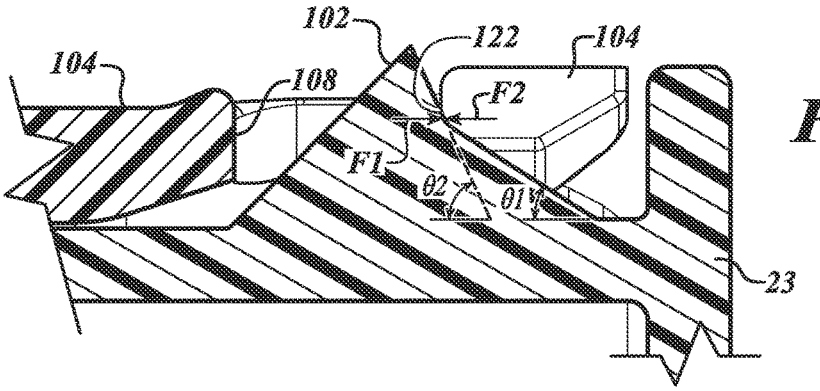
FIG. 13 is a close-up fragmentary cross-sectional view of the extension of the housing trapped in the recess of the end cap under a second operating condition.
Figure 14:
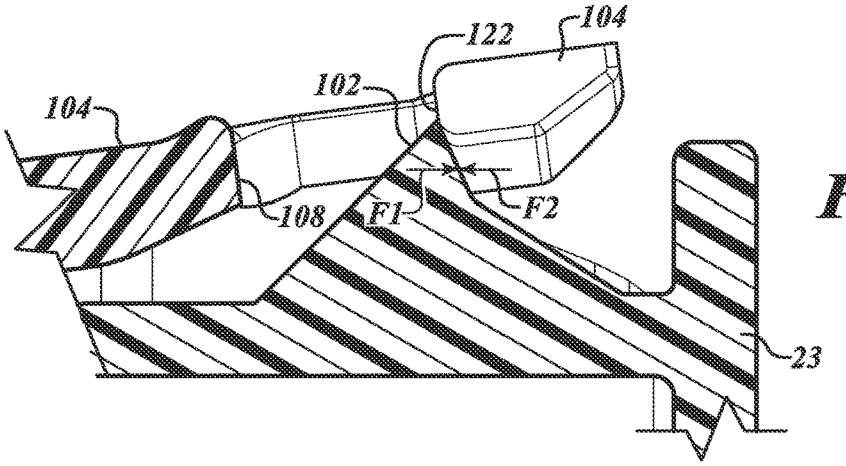
FIG. 14 is a close-up fragmentary cross-sectional view of the extension of the housing trapped in the recess of the end cap under a third operating condition.

FIGS. 12-14 show the interface of one of the extensions 102 with the flexible rim 104 in greater detail, and are representative of the interface of each of the extensions 102, 102A with the rim 104. The extension 102 shown is the lower extension of FIG. 11 but rotated in view to show the extension 102 generally upright. The extension 102 has a base 110 with a first width W1 at the outer surface 100 of the end cap 23. The bottom of the extension 102 is the base 110. Each recess 108 has a second width W2 narrower than the first width W1 to prevent the base 110 from fitting within the recess 108 under the predetermined range of operating conditions. In other words, the base 110 is configured to be too wide to fit within the recess 108 under the entire range of operating conditions, including swelling of the end cap 23 and housing 12 that can occur in the presence of fuel, and re-drying of the end cap 23 and housing 12 after such swelling. As shown in FIG. 12, the position of the rim 104 on the extension 102 is a nominal state representing operating conditions that are neither: (i) those causing a maximum swell of components; nor (ii) those causing a minimum size of the components, such as would occur without any swelling after a re-dry.

Each extension 102, 102A has a first angled surface 112 and a second angled surface 114 that each extend from the outer surface 100 at opposite ends of the base 110 and meet at a ridge 116. The first angled surface 112 has a first portion 118 with a first incline relative to the base 110, and a second portion 120 with a second incline relative to the base 110. The first portion 118 extends from the base 110 to the second portion 120, and the second portion 120 extends from the first portion 118 to the ridge 116. The second incline is steeper than the first incline. This is indicated in FIG. 13 by a first angle of incline $\Theta$1 of the first portion 118 being less than a second angle of incline $\Theta$2 of the second portion 120.

The extension 102 is configured so that an edge 122 of the flexible rim 104 at the recess 108 in which the extension 102 is retained rests along the first angled surface 112 under the entire predetermined range of operating conditions. An overall axial dimension X shown in FIG. 3 in which the nozzle carrier 46 and nozzle 48 are constrained changes as the nozzle carrier 46, end cap 23, and housing 12 swell due to fuel exposure and shrink due to re-drying after exposure to fuel or other medium. Both the relative axial dimensions of these components as well as the clearances between the components change. For example, FIG. 13 represents the relative positions of the extension 102 and the flexible rim 104 when nozzle carrier 46, end cap 23, and housing 12 shrink due to re-drying after exposure to fuel or other medium. FIG. 13 represents the minimum sizes of these components under these predetermined operating conditions. In that instance, because the axial dimension X is likely to shrink, the extensions 102, 102A will be axially closer to the recesses 108, there will be less tension between the flexible rim 104 and the extensions 102, 102A, and the edge 122 of the rim 104 will rest closer to the base 110 along the first portion 118 of surface 112 than under the first predetermined operating condition of FIG. 12. Even under this operating condition, however, the rim 104 is prevented from returning to an unflexed state, and some force F1 and reaction force F2 is maintained, also acting on the nozzle carrier 46 and nozzle 48 to keep these components form relative axial movement. That is, the forces F1, F2 also act at the second end 60 of the nozzle carrier 46 and the housing 12, and at the stepped shoulder 72 and the nozzle 48, as shown in FIG. 3.

FIG. 14 represents the relative positions of the extension 102 and the flexible rim 104 when the nozzle carrier 46, end cap 23, and housing 12 swell due to exposure to fuel or other medium. FIG. 14 represents the maximum sizes of these components under all of the operating conditions. In that instance, because the axial dimension X is likely to be larger, the extensions 102, 102A will be axially further from the recesses 108, there will be greater tension between the flexible rim 104 and the extensions 102, 102A, and the edge 122 of the rim 104 will rest further from the base 110 along the second portion 120 of surface 112. The rim 104 is prevented from returning to an unflexed state, and a force F1 and reaction force F2 is maintained, also acting on the nozzle carrier 46 and nozzle 48 to keep these components from relative axial movement.

Figure 15:
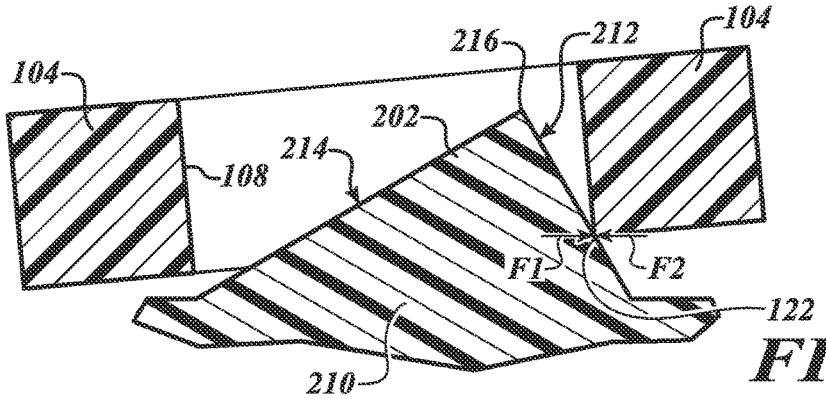
FIG. 15 is a close-up fragmentary cross-sectional view of an alternate extension for the housing shown trapped in the recess of the end cap under the first operating condition.
Figure 16:
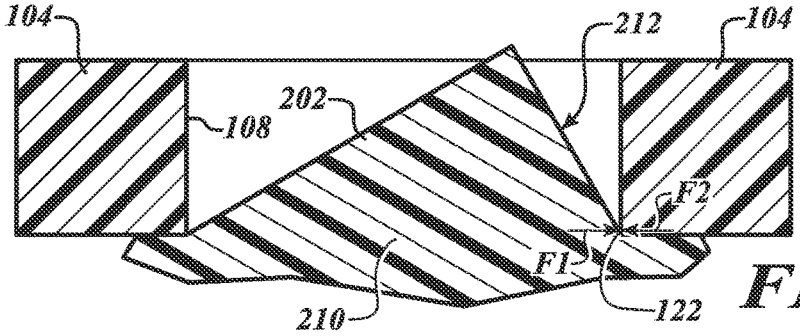
FIG. 16 is a close-up fragmentary cross-sectional view of the alternate extension of the housing trapped in the recess of the end cap under the second operating condition.
Figure 17:
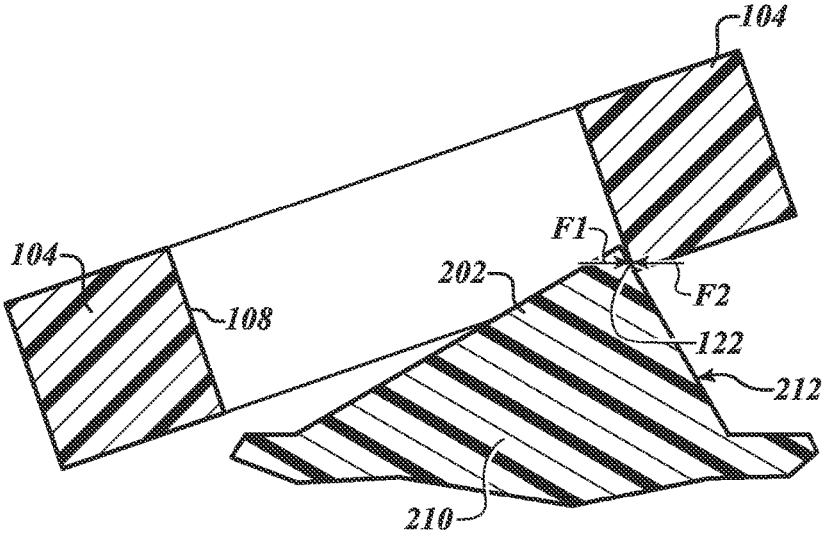
FIG. 17 is a close-up fragmentary cross-sectional view of the alternate extension of the housing trapped in the recess of the end cap under the third operating condition.

FIGS. 15-17 show an alternate extension 202 that can be used with other like spaced extensions on the end cap 23 to interface with the flexible rim 104 in a manner that will provide a constant tension and resultant axial force on the nozzle carrier 46 and nozzle 48 under the predetermined range of operating conditions. The extension 202 has a first angled surface 212 and a second angled surface 214 both extending from a base 210 and meeting at at ridge 216. Unlike the extension 102, the first angled surface 212 does not have different portions with different angles of incline relative to the base 110.

FIG. 15 shows the rim 104 and extension 202 in a nominal state in which the edge 122 of the rim 104 at the recess 108 interfaces with the first angled surface 212. The rim 104 is prevented from returning to an unflexed state, and some force F1 and reaction force F2 is maintained at each extension 202, also acting on the nozzle carrier 46 and nozzle 48 to keep these components from relative axial movement.

FIG. 16 represents the relative positions of the extension 202 and the flexible rim 104 when the nozzle carrier 46, end cap 23, and housing 12 shrink due to re-drying after exposure to fuel or other medium. FIG. 16 represents the minimum sizes of these components under all of the operating conditions. In that instance, because the axial dimension X of FIG. 3 is likely to be smaller, the extensions 202 will be axially closer to the recesses 108, there will be less tension between the flexible rim 104 and the extensions 202, and the edge 122 of the rim 104 will rest closer to the base 210 along the surface 212. Even under this operating condition, the rim 104 is prevented from returning to an unflexed state, and a force F1 and reaction force F2 are maintained, also acting on the nozzle carrier 46 and nozzle 48 to keep these components from relative axial movement.

FIG. 17 represents the relative positions of the extension 202 and the flexible rim 104 when the nozzle carrier 46, end cap 23, and housing 12 swell due to exposure to fuel or other medium. FIG. 17 represents the maximum sizes of these components under all of the operating conditions. In that instance, because the axial dimension X of FIG. 3 is likely to be larger, the extensions 202 will be axially further from the recesses 108, there will be greater tension between the flexible rim 104 and the extensions 202, and the edge 122 of the rim 104 will rest further from the base 210 along the surface 212. The rim 104 is prevented from returning to an unflexed state, and a force F1 and reaction force F2 are maintained, also acting on the nozzle carrier 46 and nozzle 48 to keep these components from relative axial movement.

The constant tension snap-fit ability of the extensions 102 or 202 on a first component (such as a housing 12) and recesses 108 on a second component (such as an end cap 23) could be used in other applications. In other words, an assembly other than a liquid trap assembly having the extensions and recesses with a constant tension snap-fit as described could be used to provide requisite constant axial force on other components requiring no relative axial movement.

The reference numbers used in the drawings and the specification along with the corresponding components are as follows:

10 liquid trap assembly
12 housing/second component
13 upper cap
14 first port/vapor flow inlet
15 tab
16 second port/vapor flow outlet
17 tab retainer
18 interior cavity
19 filter
20 liquid trap
21 fuel vapor recovery system
22 fuel tank
23 end cap/first component
26 vapor vent valve
28 canister (C)
30 engine (E)
35 first opening of housing 12
36 check valve
38 valve body
40 spring
42 valve cavity
44 jet pump assembly
46 nozzle carrier
47 ridges
48 venturi nozzle
50 entrance port
50A entrance port
50B entrance port
50C entrance port
51 filter
52 longitudinal passage of nozzle carrier
53 lower extent of cavity 42
54 carrier portion
55 wall
56 first end of nozzle carrier 46
57 passage
58 diffuser portion
59 diffuser passage
60 second end of nozzle carrier 46
61 reducer
62 body portion of nozzle 48
63 inlet portion of housing 12
64 inlet of nozzle 48
65 outlet of housing 12
66 nozzle portion
67 clearance of nozzle 48 to carrier portion 54
68 nozzle tip
70 outlet of nozzle 48
71 predetermined clearance
72 first stepped shoulder of body portion
73 clearance first stepped portion 75 and cylindrical extension 77
74 first cylindrical cavity of end cap
75 first stepped portion of nozzle 48
76 first clearance of end cap 23 to carrier portion 54
77 cylindrical extension of end cap
78 cylindrical cavity of housing 12
79 second shoulder of nozzle 48
80 press-fit portion
81 second shoulder portion
82 radial clearance of diffuser portion 58 and housing 12
83 clearance second shoulder portion 81 to end cap 23
84 exterior surface of diffuser portion 58
85 resilient ring
87 O-ring seal
90 tubing
92 fuel pump (P)
93 liquid fuel
94 fuel discharge tubing
100 first outer surface of end cap 23
102 extensions of end cap 23
102A extensions of end cap 23
104 flexible rim of housing 12
105 cavity of housing 12
106 flap portions of rim
108 recesses in rim
109 center portion of extension 102A
110 base of extension 102
112 first angled surface
114 second angled surface
116 ridge
118 first portion of first angled surface
120 second portion of second angled surface
122 edge of rim 104
146 nozzle carrier
148 nozzle
202 extension
210 base
212 first angled surface
214 second angled surface
216 ridge
A1 longitudinal center axis of nozzle carrier 48
A2 longitudinal center axis of nozzle 48
A3 center axis of rim 104 and end cap 13
C canister
E engine
F force of rim
F1 force of extension 102 on rim 104
F2 reaction force of rim on extension
P pump
X axial dimension
W1 first width of base W2 width of recess Θ1 first angle of incline Θ2 second angle of incline While the best modes for carrying out the many aspects of the present teachings have been described in detail, those familiar with the art to which these teachings relate will recognize various alternative aspects for practicing the present teachings that are within the scope of the appended claims.

The invention claimed is:

1. A jet pump assembly comprising:

a unitary nozzle carrier having a wall with an entrance port; wherein the nozzle carrier has a longitudinal passage extending through the nozzle carrier and in fluid communication with the entrance port;

a unitary venturi nozzle having an inlet and a nozzle tip forming an outlet;

wherein the venturi nozzle is configured to fit to the nozzle carrier in the longitudinal passage so that alignment of a longitudinal axis of the nozzle carrier with a longitudinal axis of the venturi nozzle is affected only by the fit of the nozzle carrier to the venturi nozzle wherein the nozzle tip extends past the entrance port and is in fluid communication with the entrance port when the venturi nozzle is fit to the nozzle carrier;

wherein the venturi nozzle has a first stepped shoulder configured to abut an outer end surface of the nozzle carrier when the venturi nozzle is fit to the nozzle carrier in the longitudinal passage so that a clearance exists between the nozzle tip and the nozzle carrier;

wherein the venturi nozzle has a second stepped shoulder remote from the nozzle carrier when the first stepped shoulder abuts the outer end surface; and a seal received on the second stepped shoulder.

2. The jet pump assembly of claim 1, further comprising:

a resilient member positioned inside of the venturi nozzle at the second stepped shoulder.

3. The jet pump assembly of claim 1, wherein the nozzle carrier has spaced ridges extending into the longitudinal passage so that the venturi nozzle is fit to the nozzle carrier at the spaced ridges.

4. The jet pump assembly of claim 1, wherein the entrance port is a first entrance port, and further comprising:

an additional entrance port extending through the nozzle carrier in fluid communication with the longitudinal passage, and spaced angularly from the first entrance port.

5. The jet pump assembly of claim 1, in combination with a housing forming a liquid trap and an end cap closing one end of the housing; wherein the entrance port is in operative fluid communication with the liquid trap; and wherein the nozzle carrier is supported by both the housing and the end cap.

6. The jet pump assembly in combination with the housing and end cap of claim 5, wherein a first clearance is defined between the nozzle carrier and the end cap under a predetermined range of operating conditions; and wherein the nozzle carrier and the housing are configured to have a press-fit along only a portion of an exterior surface of the nozzle carrier under the predetermined range of operating conditions; the nozzle carrier and the venturi nozzle thereby being movable as a unit relative to the end cap and the housing within the first clearance without affecting the alignment of the longitudinal axis of the nozzle carrier with the longitudinal axis of the venturi nozzle.

7. The jet pump assembly of claim 5, wherein the end cap has a first outer surface and a plurality of spaced extensions extending outward from the first outer surface;

wherein the housing has a flexible rim surrounding a cavity; wherein the rim has spaced recesses; wherein the rim is biased toward an unflexed state when in a flexed state;

wherein the end cap is configured to fit at least partially into the cavity with the rim flexing to surround the end cap and trap the extensions in the recesses; tension of the flexed rim maintaining a constant axial compression force on the venturi nozzle and nozzle carrier.

8. A jet pump assembly comprising:

a nozzle carrier having an entrance port; wherein the nozzle carrier has a longitudinal passage extending through the nozzle carrier and in fluid communication with the entrance port; wherein the nozzle carrier has a carrier portion extending from a first end to the entrance port, and has a diffuser portion extending from the entrance port to a second end opposite the first end;

a venturi nozzle having a body portion with an inlet, and a nozzle portion with a nozzle tip forming an outlet;

wherein the body portion is configured to fit to the carrier portion in the longitudinal passage so that alignment of a longitudinal axis of the venturi nozzle with a longitudinal axis of the nozzle carrier is dependent only on the carrier portion and the venturi nozzle; wherein the nozzle portion extends past the entrance port with the nozzle tip directed into the diffuser portion when the body portion is fit to the carrier portion; and wherein the carrier portion has spaced ridges extending into the longitudinal passage so that the body portion of the venturi nozzle is fit to the carrier portion at the spaced ridges.

9. The jet pump assembly of claim 8, wherein the venturi nozzle has a first stepped shoulder configured to abut an outer end surface of the nozzle carrier at the first end when the body portion is fit to the carrier portion in the longitudinal passage so that a predetermined clearance exists between the nozzle tip and the diffuser portion.

10. The jet pump assembly of claim 8, wherein the entrance port is a first entrance port, and further comprising:

an additional entrance port extending through the nozzle carrier in fluid communication with the longitudinal passage, and spaced angularly from the first entrance port.

11. The jet pump assembly of claim 8, in combination with a housing forming a liquid trap and an end cap closing one end of the housing; wherein the entrance port is in operative fluid communication with the liquid trap; and wherein the diffuser portion is supported by the housing and the carrier portion is supported by the end cap.

12. The jet pump assembly in combination with the housing and end cap of claim 11, wherein a first clearance is defined between the carrier portion and the end cap under a predetermined range of operating conditions; and wherein the diffuser portion and the housing are configured to have a press-fit along only a portion of an exterior surface of the diffuser portion under the predetermined range of operating conditions; the nozzle carrier and the venturi nozzle thereby being movable as a unit relative to the end cap and the housing within the first clearance without affecting the alignment of the longitudinal axis of the nozzle carrier with the longitudinal axis of the venturi nozzle.

13. A jet pump assembly comprising:

a unitary nozzle carrier having a wall with a first entrance port; wherein the nozzle carrier has a longitudinal passage extending through the nozzle carrier and in fluid communication with the first entrance port; wherein the wall has an additional entrance port extending through the nozzle carrier in fluid communication with the longitudinal passage, and spaced angularly from the first entrance port;

a unitary venturi nozzle having an inlet and a nozzle tip forming an outlet;

wherein the venturi nozzle is configured to fit to the nozzle carrier in the longitudinal passage so that alignment of a longitudinal axis of the nozzle carrier with a longitudinal axis of the venturi nozzle is affected only by the fit of the nozzle carrier to the venturi nozzle wherein the nozzle tip extends past the first entrance port and is in fluid communication with the entrance port when the venturi nozzle is fit to the nozzle carrier;

wherein the venturi nozzle has a first stepped shoulder configured to abut an outer end surface of the nozzle carrier when the venturi nozzle is fit to the nozzle carrier in the longitudinal passage so that a clearance exists between the nozzle tip and the nozzle carrier; and wherein the nozzle carrier has spaced ridges extending into the longitudinal passage so that the venturi nozzle is fit to the nozzle carrier at the spaced ridges.

14. The jet pump assembly of claim 13, wherein the venturi nozzle has a second stepped shoulder remote from the nozzle carrier when the first stepped shoulder abuts the outer end surface; and a seal received on the second stepped shoulder.

15. The jet pump assembly of claim 14, further comprising:

a resilient member positioned inside of the venturi nozzle at the second stepped shoulder.

16. The jet pump assembly of claim 13, in combination with a housing forming a liquid trap and an end cap closing one end of the housing; wherein the entrance port is in operative fluid communication with the liquid trap;

wherein the nozzle carrier has a carrier portion extending from a first end to the first entrance port, and has a diffuser portion extending from the first end to a second end opposite the first end; and wherein the diffuser portion is supported by the housing and the carrier portion is supported by the end cap.

17. A jet pump assembly comprising:

a unitary nozzle carrier having a wall with an entrance port; wherein the nozzle carrier has a longitudinal passage extending through the nozzle carrier and in fluid communication with the entrance port;

a unitary venturi nozzle having an inlet and a nozzle tip forming an outlet;

wherein the venturi nozzle is configured to fit to the nozzle carrier in the longitudinal passage so that alignment of a longitudinal axis of the nozzle carrier with a longitudinal axis of the venturi nozzle is affected only by the fit of the nozzle carrier to the venturi nozzle wherein the nozzle tip extends past the entrance port and is in fluid communication with the entrance port when the venturi nozzle is fit to the nozzle carrier; and wherein the nozzle carrier has spaced ridges extending into the longitudinal passage so that the venturi nozzle is fit to the nozzle carrier at the spaced ridges.

18. A jet pump assembly comprising:

a unitary nozzle carrier having a wall with an entrance port; wherein the nozzle carrier has a longitudinal passage extending through the nozzle carrier and in fluid communication with the entrance port;

a unitary venturi nozzle having an inlet and a nozzle tip forming an outlet;

wherein the venturi nozzle is configured to fit to the nozzle carrier in the longitudinal passage so that alignment of a longitudinal axis of the nozzle carrier with a longitudinal axis of the venturi nozzle is affected only by the fit of the nozzle carrier to the venturi nozzle wherein the nozzle tip extends past the entrance port and is in fluid communication with the entrance port when the venturi nozzle is fit to the nozzle carrier;

in combination with a housing forming a liquid trap and an end cap closing one end of the housing; wherein the entrance port is in operative fluid communication with the liquid trap; wherein the nozzle carrier is supported by both the housing and the end cap;

wherein a first clearance is defined between the nozzle carrier and the end cap under a predetermined range of operating conditions; and wherein the nozzle carrier and the housing are configured to have a press-fit along only a portion of an exterior surface of the nozzle carrier under the predetermined range of operating conditions; the nozzle carrier and the venturi nozzle thereby being movable as a unit relative to the end cap and the housing within the first clearance without affecting the alignment of the longitudinal axis of the nozzle carrier with the longitudinal axis of the venturi nozzle.

19. A jet pump assembly comprising:

a unitary nozzle carrier having a wall with an entrance port; wherein the nozzle carrier has a longitudinal passage extending through the nozzle carrier and in fluid communication with the entrance port;

a unitary venturi nozzle having an inlet and a nozzle tip forming an outlet;

wherein the venturi nozzle is configured to fit to the nozzle carrier in the longitudinal passage so that alignment of a longitudinal axis of the nozzle carrier with a longitudinal axis of the venturi nozzle is affected only by the fit of the nozzle carrier to the venturi nozzle wherein the nozzle tip extends past the entrance port and is in fluid communication with the entrance port when the venturi nozzle is fit to the nozzle carrier;

in combination with a housing forming a liquid trap and an end cap closing one end of the housing; wherein the entrance port is in operative fluid communication with the liquid trap; wherein the nozzle carrier is supported by both the housing and the end cap;

wherein the end cap has a first outer surface and a plurality of spaced extensions extending outward from the first outer surface;

wherein the housing has a flexible rim surrounding a cavity; wherein the rim has spaced recesses; wherein the rim is biased toward an unflexed state when in a flexed state; and wherein the end cap is configured to fit at least partially into the cavity with the rim flexing to surround the end cap and trap the extensions in the recesses; tension of the flexed rim maintaining a constant axial compression force on the venturi nozzle and nozzle carrier.

20. A jet pump assembly comprising:

a nozzle carrier having an entrance port; wherein the nozzle carrier has a longitudinal passage extending through the nozzle carrier and in fluid communication with the entrance port; wherein the nozzle carrier has a carrier portion extending from a first end to the entrance port, and has a diffuser portion extending from the entrance port to a second end opposite the first end;

a venturi nozzle having a body portion with an inlet, and a nozzle portion with a nozzle tip forming an outlet;

wherein the body portion is configured to fit to the carrier portion in the longitudinal passage so that alignment of a longitudinal axis of the venturi nozzle with a longitudinal axis of the nozzle carrier is dependent only on the carrier portion and the venturi nozzle; wherein the nozzle portion extends past the entrance port with the nozzle tip directed into the diffuser portion when the body portion is fit to the carrier portion;

in combination with a housing forming a liquid trap and an end cap closing one end of the housing; wherein the entrance port is in operative fluid communication with the liquid trap; and wherein the diffuser portion is supported by the housing and the carrier portion is supported by the end cap.

21. The jet pump assembly in combination with the housing and end cap of claim 20, wherein a first clearance is defined between the carrier portion and the end cap under a predetermined range of operating conditions; and wherein the diffuser portion and the housing are configured to have a press-fit along only a portion of an exterior surface of the diffuser portion under the predetermined range of operating conditions; the nozzle carrier and the venturi nozzle thereby being movable as a unit relative to the end cap and the housing within the first clearance without affecting the alignment of the longitudinal axis of the nozzle carrier with the longitudinal axis of the venturi nozzle.

22. A jet pump assembly comprising:

a unitary nozzle carrier having a wall with a first entrance port; wherein the nozzle carrier has a longitudinal passage extending through the nozzle carrier and in fluid communication with the first entrance port; wherein the wall has an additional entrance port extending through the nozzle carrier in fluid communication with the longitudinal passage, and spaced angularly from the first entrance port;

a unitary venturi nozzle having an inlet and a nozzle tip forming an outlet;

wherein the venturi nozzle is configured to fit to the nozzle carrier in the longitudinal passage so that alignment of a longitudinal axis of the nozzle carrier with a longitudinal axis of the venturi nozzle is affected only by the fit of the nozzle carrier to the venturi nozzle wherein the nozzle tip extends past the first entrance port and is in fluid communication with the entrance port when the venturi nozzle is fit to the nozzle carrier;

wherein the venturi nozzle has a first stepped shoulder configured to abut an outer end surface of the nozzle carrier when the venturi nozzle is fit to the nozzle carrier in the longitudinal passage so that a clearance exists between the nozzle tip and the nozzle carrier;

wherein the venturi nozzle has a second stepped shoulder remote from the nozzle carrier when the first stepped shoulder abuts the outer end surface; and a seal received on the second stepped shoulder.

23. The jet pump assembly of claim 22, further comprising:

a resilient member positioned inside of the venturi nozzle at the second stepped shoulder.

24. A jet pump assembly comprising:

a unitary nozzle carrier having a wall with a first entrance port; wherein the nozzle carrier has a longitudinal passage extending through the nozzle carrier and in fluid communication with the first entrance port; wherein the wall has an additional entrance port extending through the nozzle carrier in fluid communication with the longitudinal passage, and spaced angularly from the first entrance port;

a unitary venturi nozzle having an inlet and a nozzle tip forming an outlet;

wherein the venturi nozzle is configured to fit to the nozzle carrier in the longitudinal passage so that alignment of a longitudinal axis of the nozzle carrier with a longitudinal axis of the venturi nozzle is affected only by the fit of the nozzle carrier to the venturi nozzle wherein the nozzle tip extends past the first entrance port and is in fluid communication with the entrance port when the venturi nozzle is fit to the nozzle carrier;

wherein the venturi nozzle has a first stepped shoulder configured to abut an outer end surface of the nozzle carrier when the venturi nozzle is fit to the nozzle carrier in the longitudinal passage so that a clearance exists between the nozzle tip and the nozzle carrier;

in combination with a housing forming a liquid trap and an end cap closing one end of the housing; wherein the entrance port is in operative fluid communication with the liquid trap;

wherein the nozzle carrier has a carrier portion extending from a first end to the first entrance port, and has a diffuser portion extending from the first end to a second end opposite the first end; and wherein the diffuser portion is supported by the housing and the carrier portion is supported by the end cap.

* * * * *